United States Patent [19]

Kuei et al.

[11] Patent Number: 4,843,371

[45] Date of Patent: Jun. 27, 1989

[54] BURGLAR-ALARM SYSTEM FOR BRIEFCASE

[76] Inventors: Liu C. Kuei, No. 36, Jen Ai Hsin Village, Division 2, Hsin She Village, Chu Pei Hsiang, Hsin Chu Hsien; Chen C. Shui, No. 1, Lane 19, Wan Lung Street, Division 39, Wan Lung Li, Ching Mei District, Taipei; Huang C. Lung, No. 175, Sec. 1, Chung Shan Road, Division 15, Jui Sui Hsiang, Hualien Hsien, all of Taiwan

[21] Appl. No.: 152,677

[22] Filed: Feb. 5, 1988

Related U.S. Application Data

[63] Continuation-in-part of Ser. No. 16,772, Feb. 20, 1987, abandoned.

[51] Int. Cl.[4] ..... G08B 1/08; G08B 13/14

[52] U.S. Cl. ..... 340/539; 340/571

[58] Field of Search ..... 340/539, 531, 571, 572, 340/568, 574, 573, 689

[56] References Cited

U.S. PATENT DOCUMENTS

| | | | |
|---|---|---|---|
| 4,155,079 | 5/1979 | Chiu et al. | 340/571 |
| 4,272,763 | 6/1981 | Chang et al. | 340/571 |
| 4,591,835 | 5/1986 | Sharp | 340/689 |
| 4,593,273 | 6/1986 | Narcisse | 340/539 |

*Primary Examiner*—Donnie L. Crosland
*Attorney, Agent, or Firm*—Morton J. Rosenberg

[57] ABSTRACT

A burglar-alarm system for a briefcase and in particular to one which will generate high voltage on the surface of the briefcase to force the thief to throw away the briefcase, giving an alarming sound, emitting brilliant flashes of light, evolving colored smokes to arouse attention of the pedestrians and automatically destroying the articles therein so as to prevent the briefcase from being taken away in case of theft or incorrectly dialing the electronic combination lock in the briefcase.

1 Claim, 8 Drawing Sheets

BURGLAR-ALARM SYSTEM FOR BRIEFCASE

CROSS-REFERENCE

This application is a continuation-in-part of the application Ser. No. 07/016,772, filed Feb. 20, 1987, now abandoned.

BACKGROUND OF THE INVENTION

This invention relates to a burglar-alarm system for a briefcase.

It is found that all briefcases on the market only use a combination lock or a chain as the means for preventing being stolen. However, such means are ineffective to the master in stealing. Hence, many kinds of burglar-alarm briefcases have been developed, attempting to obviate and mitigate the above-mentioned drawbacks. For example, U.S. Pat. No. 4,155,079 to Chiu et al is directed to a theft-proof suitcase which will cause a plug to be detached from a jack to supply power to an alarm circuit to provide audible and visible alarms when the suitcase is snatched away. Another burglar-alarm attache case is disclosed in U.S. Pat. No. 4,272,763, which will produce a high voltage electric shock when micro switches are produced and which will also send out an alarm when the attache case is robbed away. Further, U.S. Pat. No. 4,593,273 describes an out-of-range personnel monitor and alarm by means of which the supervisory personnel at a base unit will become alerted in case the supervised personnel carrying a mobile unit leave a prescribed area. Moreover, according to U.S. Pat. No. 4,591,835, a remotely activatable alarm system is suggested which includes a container, a handle, a lock, smoke and sound outlets, a smoke emitting device, an audio alarm, a receiver and a transmitter.

Nevertheless, none of the references are satisfactory in use and therefore, it is an object of the present invention to provide an improved burglar alarm system for briefcases.

SUMMARY OF THE INVENTION

This invention relates to a burglar-alarm system for a briefcase.

It is the primary object of the present invention to provide a burglar-alarm for a briefcase which will generate a current of high potential in case of theft or incorrectly dialing the combination lock.

It is another object of the present invention to provide a burglar-alarm system for a briefcase which will actuate an alarm as well as a flasher to arouse attention of the pedestrian in case of theft or incorrectly dialing the combination lock.

It is still another object of the present invention to provide a burglar-alarm system for a briefcase which will evolve smoke to arouse attention of the pedestrian in case of theft or incorrectly dialing the combination lock.

It is still another object of the present invention to provide a burglar-alarm system for a briefcase which will automatically destroy all articles therein when the briefcase is snatched away.

It is still another object of the present invention to provide a burglar-alarm system for a briefcase which is provided with a wireless receiver adapted to a portable transmitter so that when the distance between the receiver and the transmitter exceeds the present destance, the aforesaid means will all be actuated.

It is a further object of the present invention to provide a burglar-alarm system for a briefcase which is easy to use.

The novel features which are characteristics of the invention, together with further objects and advantages thereof will be better understood from the following description considered in connection with the accompanied drawings and in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
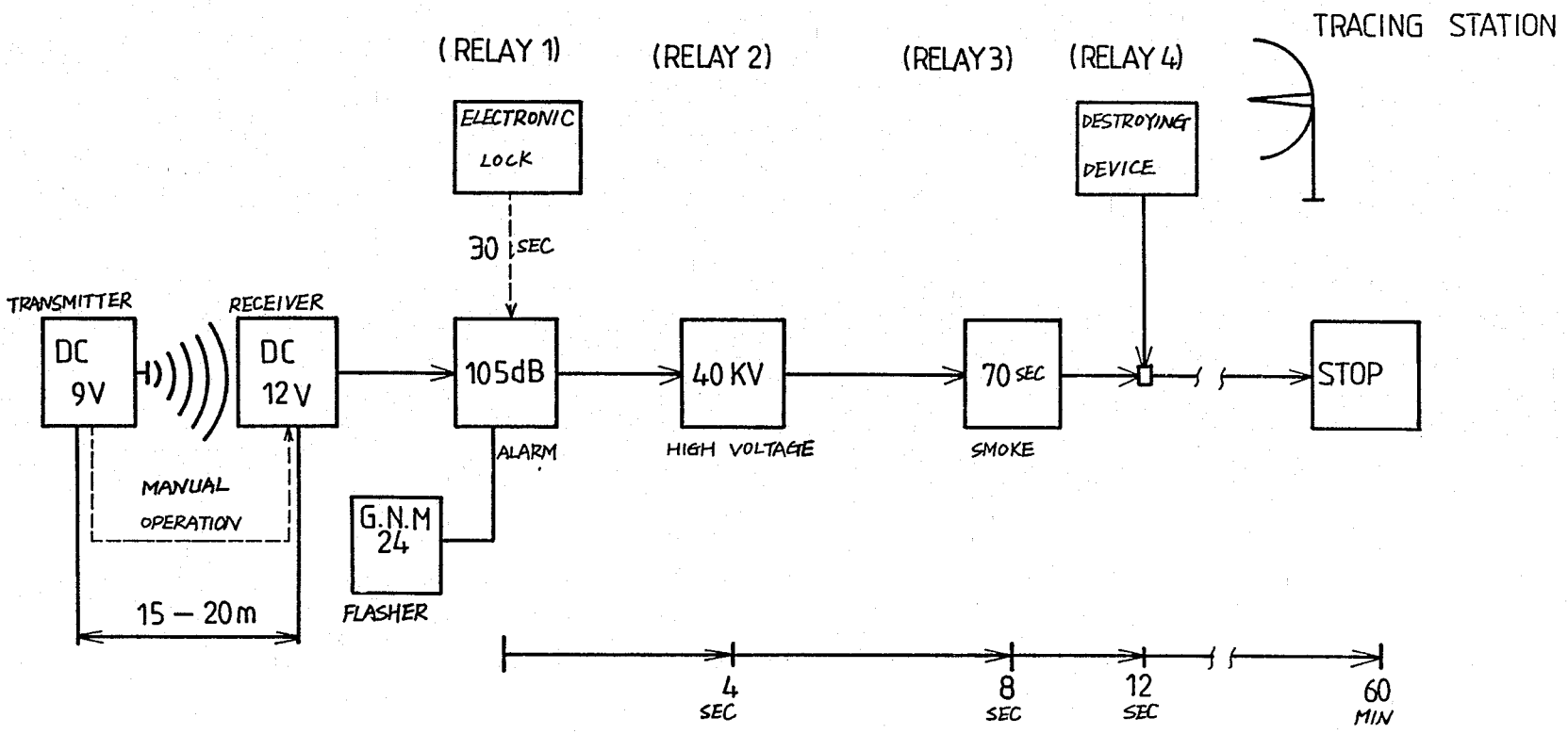
FIG. 1 is a block diagram of a burglar-alarm system for a briefcase according to the present invention.
Figure 2:
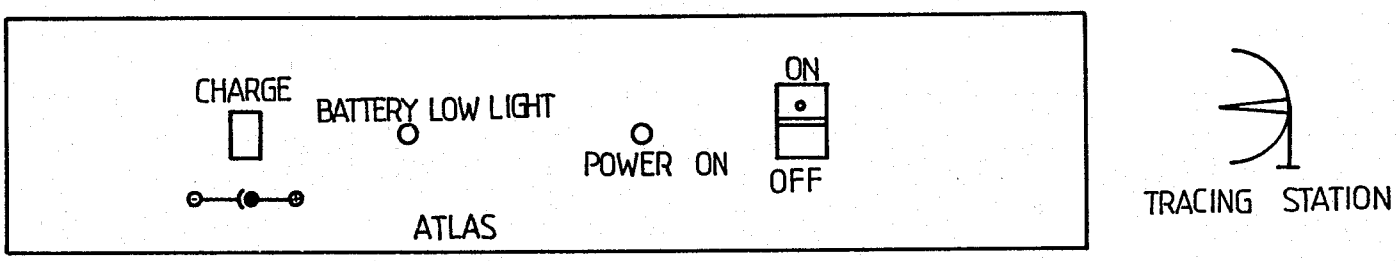
FIG. 2 shows the controlling board of the present invention.
Figure 3:
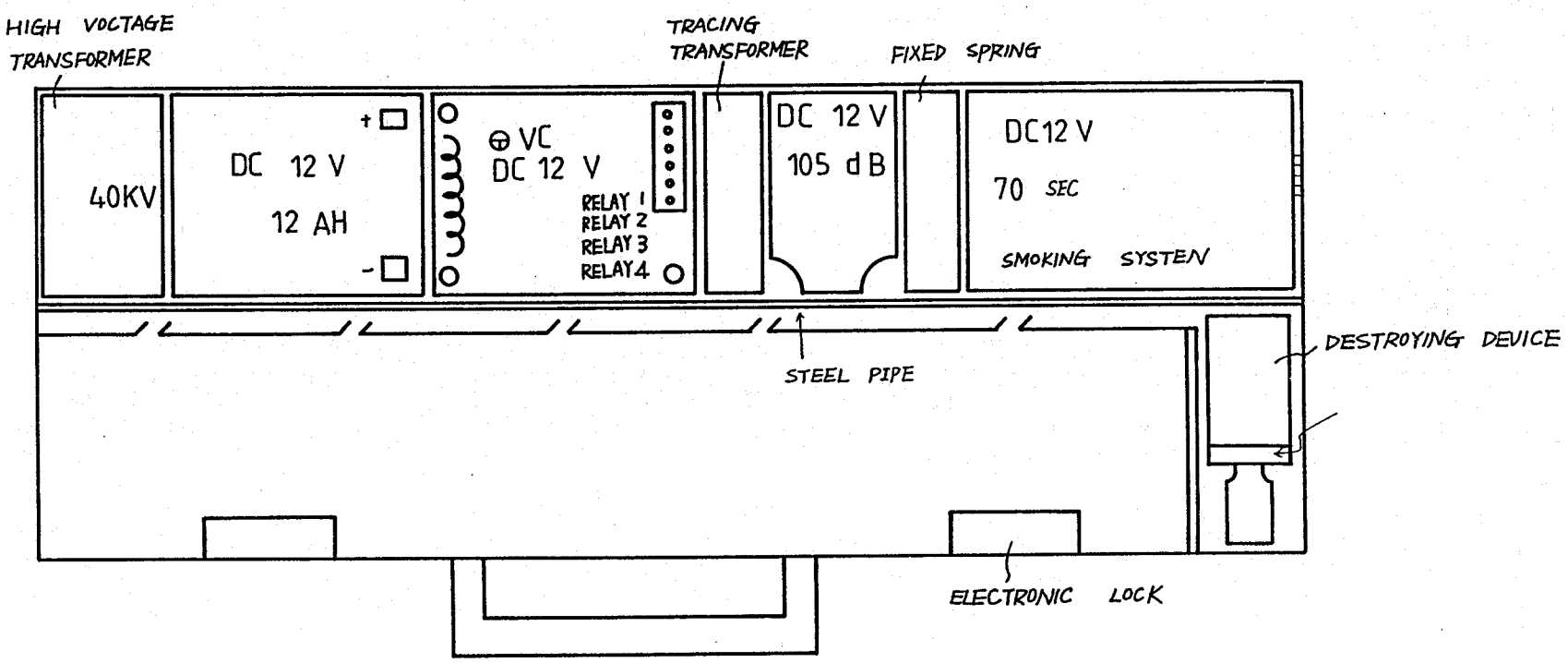
FIG. 3 shows the internal arrangement of the present invention.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to the drawings and in particular to FIG. 1 thereof, the burglar-alarm system for briefcase according to the present invention mainly comprises a wireless transmitter 1 and a control device 2 mounted in the briefcase. The control device 2 is constituted by a wireless reciver 3, a secondary cell 32, an electronic combination lock 33, a main controller 34, a high-voltage generator 35, an alarm 36, a smoking circuit 37, a smoking can 38, an intense transmitter 39, a flasher 40 and a destroying device 41. The secondary cell 32 of the control system 2 is to provide a power source for all parts. The secondary cell 32 can be recharged when required. The inspecting portion of the control device 2 is constituted by the wireless receiver 3 and the electronic combination lock 33. The wireless receiver 3 is associated with the above-mentioned wireless transmitter 1 o form a distance-measuring device. When the distance therebetween exceeds the effictive range of the receiver 3, the output of the receiver 3 will be changed which in turn will trigger the main controller 34. In use, the transmitter 1 may be conveniently put into the pocket of the holder. If the briefcase is taken away by the thief, the generators in the briefcase will work thereby scaring away the thief. Further, the combination lock 33 is disposed on the briefcase, which will also actuate the present system if the code numbers of the combination lock 33 are not correct. As stated above, by means of the above-mentioned two meansures, the present system can provide the briefcase an effective burglar alarm.

The driving portion of the present invention is composed of other parts of the control device 2. The main controller 34 is to change the triggering signal of the above-mentionoed inspecting portion into control signal so as to actuate the other parts. The seven functions of the present system are now described in detail as follows:

1. HIGH VOLTAGE

Figure 8:
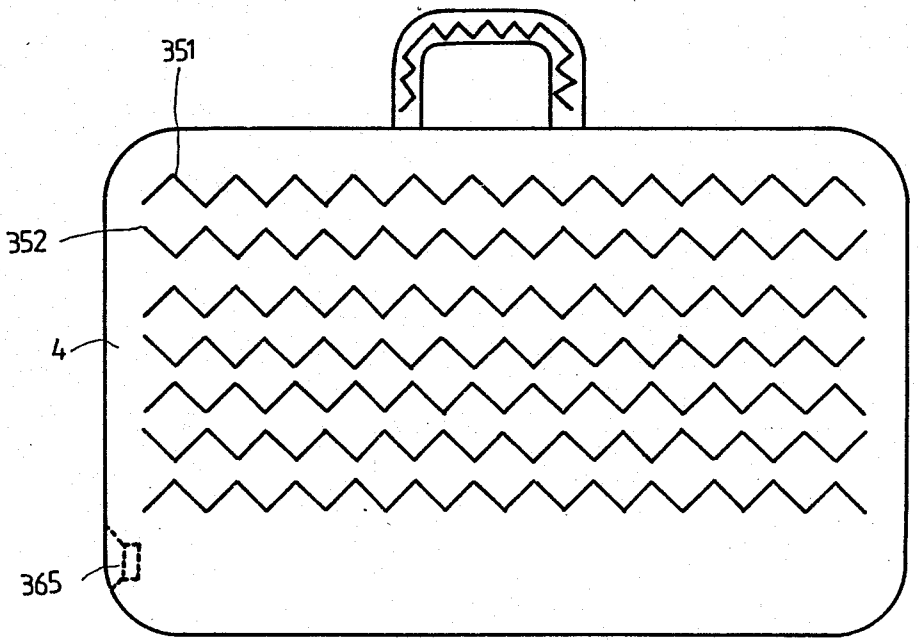
FIG. 8 shows the arrangement of the wire under the surface of the briefcase.

The high voltage generator 35 will supply a high voltage between the two electrodes 351 and 352. As shown In FIG. 8, the two electrodes 351 and 352 are made of a serrated copper coil and disposed under the surface of the briefcase. Due to the point discharge of the electrodes 351 and 352, the thief cannot get in touch with the briefcase 4 thereby preventing the briefcase from being stolen.

2. ALARM

As the alarm 36 is actuated, the loudspeaker 365 will give a special sound to arouse attention of the pedestrian so as to frighten away the thief.

3. SMOKE

When the smoking circuit 37 is actuated, the smoking can 36 will be ignited to produce colored smokes from the surface of the briefcase thereby arousing attention of the pedestrian.

4. TRANSMITTER

By means of the electrical circuits, the briefcase can produce a strong radio wave so that it can be detected by the tracing station 12.

5. ELECTRONIC LOCK

The lock will actuate the present system if the code numbers thereof are wrongly dialed hence increasing the safety of the briefcase.

6. FLASHER

In case the briefcase is robbed away, the flasher 40 will cause lights to go on and off intermittently at the same time as the alarm is actuated.

7. DESTROYING DEVICE

The articles in the briefcase will be automatically destroyed in a predetermined time from the actuation of the alarm.

The above-mentioned seven functions will work in predetermined order and so even if one of them is broken down, the other six functions can still work effectively thereby enhancing the safety of the briefcase.

Figure 4:
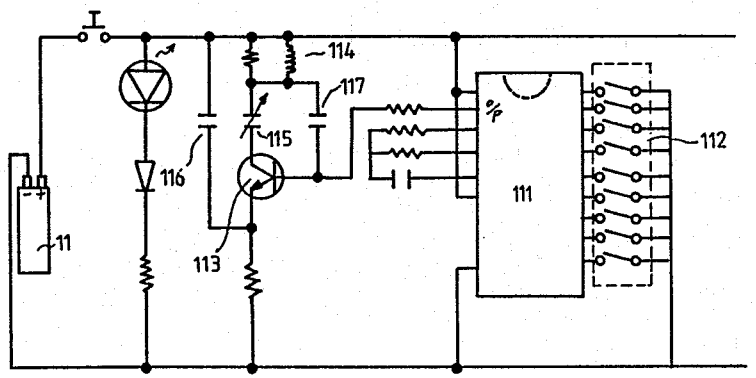
FIG. 4 is an electrical diagram of the wireless transmitter of the present invention.

With reference to FIG. 4, there is shown an electrical circuit of the wireless transmitter 1. The wireless transmitter 1 comprises a cell 11, a carrier wave generator, a coder 111 and a switch 112. The switching groups of the switch 112 are all connected within the coder 111 to set the modulated type of the code 111. The output (O/P) of the coder 111 will produce secret code modulated signal which in turn will be transmitted to the carrier wave generator composed of the transistor 113, the induction coil 114 and the capacitors 115–117 so as to modulate the carrier wave signal to cause the transmitter 1 to produce modulated wave from the induction coil 114. The transmitter 1 is operated at U H F and when the switching condition of the switch 112 is changed, the modulating type can be changed to prevent from being disturbed by the other receivers.

Figure 5:
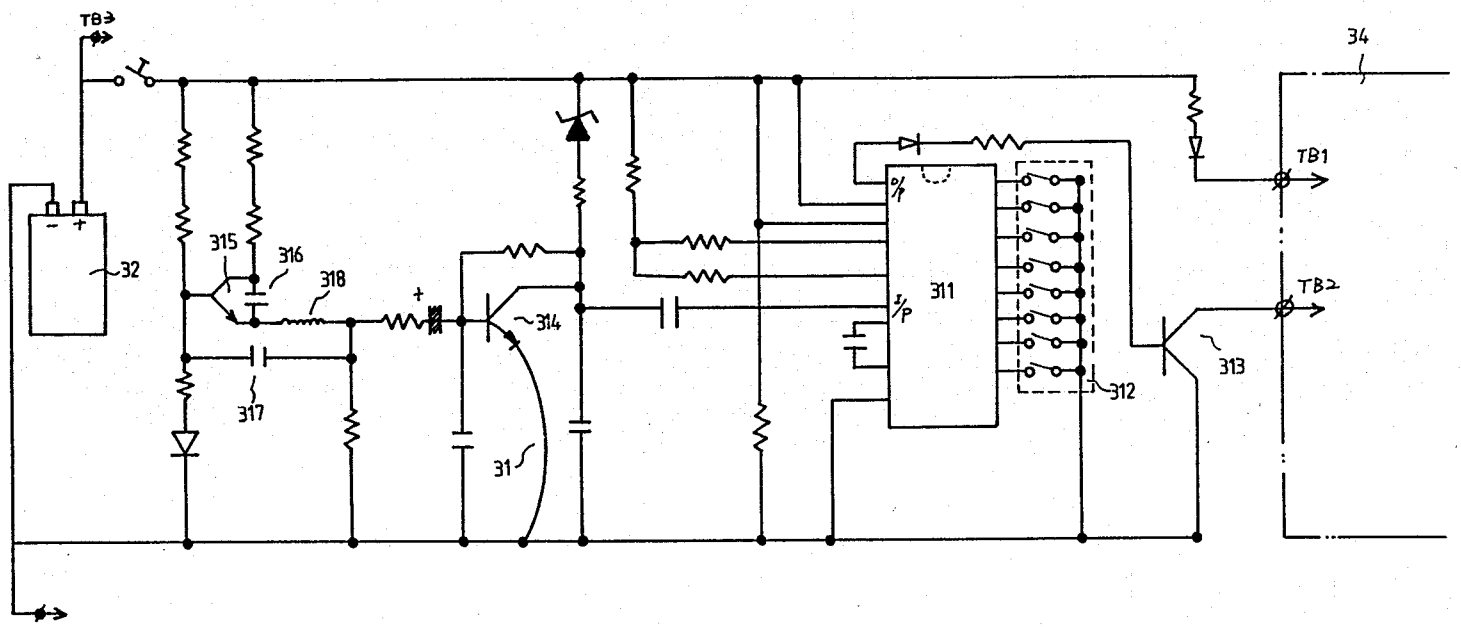
FIG. 5 is an electrical diagram of the wireless receiver of the present invention.

FIG. 5 shows the electrical circuit of the receiver 3. As can be seen, the receiver 3 comprises a secondary cell 32, a decoder 311, a switch 312 and some other circuitries. The receiving circuitry is composed of a radio freqrency amplifying circuit and a local oscillating circuit. The radio frequency amplifying circuit comprises a transistor 314 while a transistor 315, capacitors 316 and 317, and an induction coil 318 constitute the local oscillating circuit. As the outside signal is received by an antenna 31, it is modulated with the local oscillating frequency to remove the carrier frequency. After being detected, it is transmitted to the input of the decoder 311 to compare with the decoding type preset in the decoder 311 by the switch 312. The switch 312 has the same secret code as the transmitter 1 so that the output (O/P) can be converted into high potential which will conduct a transistor 313 via the base thereof. Hence, when the transmitter 1 is located within the effective range of the receiver 3, the collector of the transistor 313 will be at low potential. As the transmitter 1 is located beyond the effective range of the receiver 3, the output TB1 and TB2 of the receiver 3 will be via the positive power source and the collector of the transistor 313 and the output signals will become control signals of the main controller 34.

Figure 6:
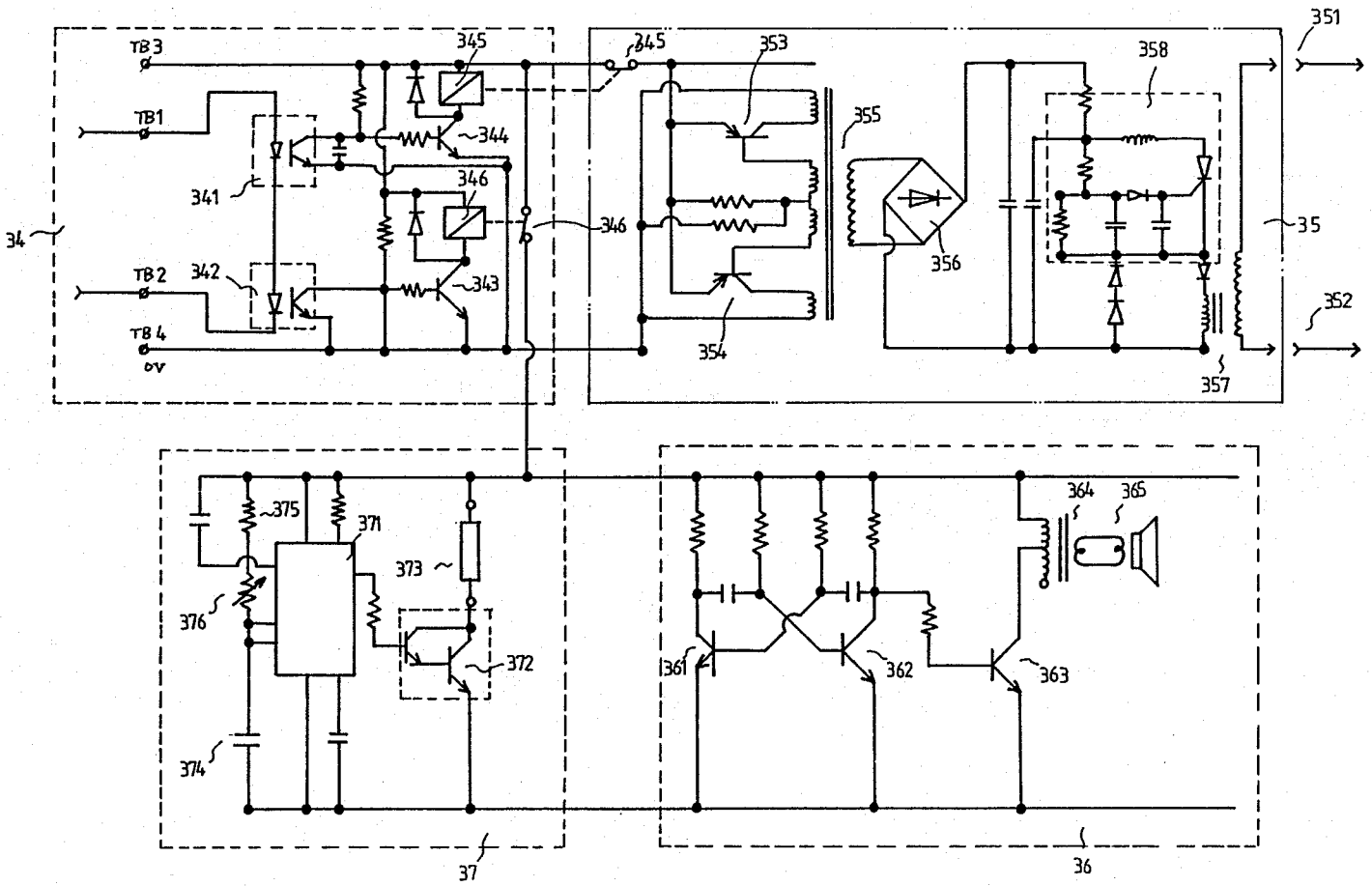
FIG. 6 is an electrical diagram of the main controller of the present invention.
Figure 7:
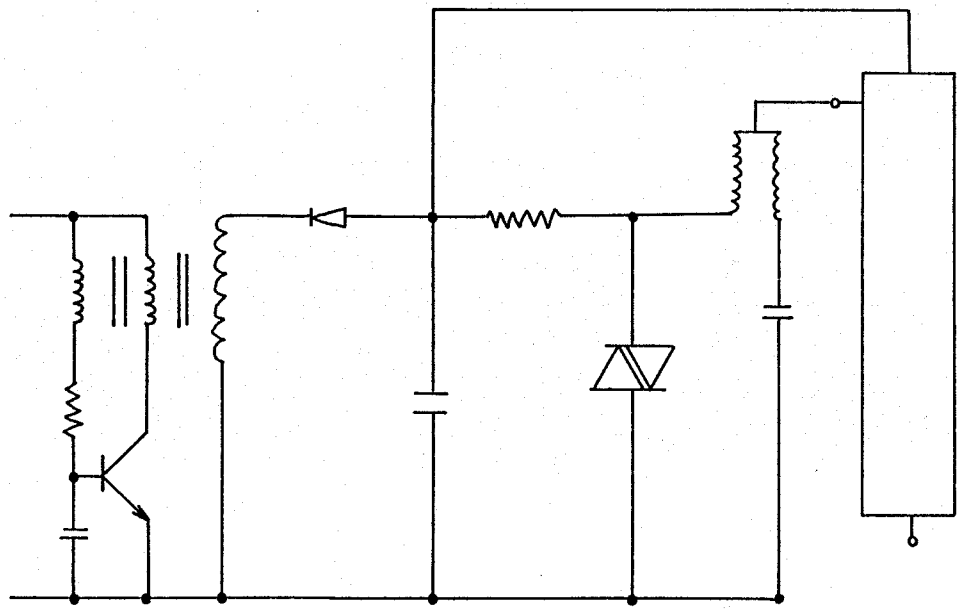
FIG. 7 is an electrical diagram of the flasher of the present invention.

Looking now at FIG. 6, there is shown the electrical circuits of the main controller 34, the high potential gnerator 35, the smoking means 37 and the alarm 36. The main controller 34 is composed of two photo-clutches 341 and 342, two transistors 343 and 344 and two relays 345 and 346. The photo-diodes of the two photo-clutches 341 and 342 are first connected in series and then across the input signals TB1 and TB2. The two transistors of the photo-clutches 341 and 342 respectively drive the two transistors 344 and 343 the collectores of which in turn drive a respective coil of the relays 345 and 346. The normal-closed point of the relays 345 and 346 supplies the positive power source to the generators. In case the main controllerr 34 does not work, the other generators can still provide their own electricity to work. When the main controller 34 works, the power supply of the generators is cut off to stop the generators. Consequently, when the receiver 3 is under normal condition, the main controller 34 will cut off the power supply of the generators, and when the receiver 3 does not work, the generators will be actuated to give alarming effects.

The high voltage generator 35 is comprised of two transistors 353 and 354 and a transformer 355. Firstly, the positive power source is converted into alternating current and steped up by the transformer 355. Then, it is rectified by a rectifier 356 and transmitted to a pulse generator 358 which is composed of a silicon controlled rectifier and phase-changing resistors and capacitors. Hence, the high current of high voltage will be converted into pulse signals which will induce the secondary winding of the pulse transformer 357. Accordingly, the outputs of the winding become the discharging electrodes 351 and 352 thereby generating a current of high potential and therefore, enabling nobody to get in touch with the briefcase.

The smoking circuit 37 comprises a timer 371, a Darlington transistor 372 and a heating coil 373, wherein the timer 371, the resistors 375 and 376 and the capacitor 374 constitute an oscillating circuit to provide an oscillating signal to the Darlington transistor 372. By means of the driving of the collector of the transistor 372, the heating coil 373 is heated and the smoking can 38 will produce colored smokes so as to arouse attention of the pedestrian.

The alarm 38 includes two transistors 361 and 362 which constitute an unstable multi-tuning oscillator to push an amplifying transistor 363, which will in trun drive the transformer 364 and the loudspeaker 365 to produce sound of a certain frequency.

FIG. 5 shows the electrical diagram of the flasher 40. The flasher 40 will causes light to go on and off intermittenlly at the same time as the alarm hence attracting the attention of others.

The desytroying device utilizes a small amount of explosive to explode a small high preessure bottle which will in turn ignite a mixture of aluminum and magnesium powder consequently destroying all articled in the briefcase.

Although this invention has been described with a certain degree of particularity, it is understood that the present disclosure is made by way of example only and that numerous chages in the construction and the combination and arrangement of parts may be resorted to without departing from the spirit and scope of the invention as hereinafter claimed.

I claim:

1. A burglar-alarm system for a briefcase comprising a portable wireless transmitter and a control device mounted in the briefcase, said control device being constituted by a wireless receiver, a rechargeable battery, an electronic combination lock, a main controller, a high-voltage generator, an alarm, a smoking circuit, a smoking can, an intense transmitter, a flasher and a destroying device, said rechargeable battery being to provide a power source for all components, said control device having an inspecting portion constituted by the wireless receiver and the electronic combination lock, said wireless receiver being associated with the wireless transmitter to form a distance-measuring device so that when the distance between the wireless receiver and the wireless transmitter exceeds effective range of the wireless receiver, the output of the wireless receiver will be changed which in turn will trigger the main controller, whereby in case of theft or incorrectly dialing the electronic combination lock, the burglar-alarm system will work thereby generating high voltage on the surface of the briefcase to force the thief to throw away the briefcase, giving an alarming sound, emitting brilliant flashes of light, evolving colored smokes to arouse attention of pedestrians and destroying articles in the briefcase.

* * * * *